US011898213B2

(12) United States Patent
Arvanitidis et al.

(10) Patent No.: US 11,898,213 B2
(45) Date of Patent: Feb. 13, 2024

(54) METHOD OF TREATING A MINING INSERT

(71) Applicants: AB SANDVIK COROMANT, Sandviken (SE); SANDVIK MINING AND CONSTRUCTION TOOLS AB, Sandviken (SE)

(72) Inventors: Ioannis Arvanitidis, Stockholm (SE); Andreas Blomqvist, Stockholm (SE); Jose Luis Garcia, Stockholm (SE); Erik Holmstrom, Sandviken (SE); Mirjam Lilja, Stockholm (SE)

(73) Assignees: AB Sandvik Coromant, Sandviken (SE); Sandvik Mining and Construction Tools AB, Sandviken (SE)

( * ) Notice: Subject to any disclaimer, the term of this patent is extended or adjusted under 35 U.S.C. 154(b) by 0 days.

(21) Appl. No.: 17/785,482

(22) PCT Filed: Dec. 18, 2020

(86) PCT No.: PCT/EP2020/087073
§ 371 (c)(1),
(2) Date: Jun. 15, 2022

(87) PCT Pub. No.: WO2021/123204
PCT Pub. Date: Jun. 24, 2021

(65) Prior Publication Data

US 2023/0036990 A1 Feb. 2, 2023

(30) Foreign Application Priority Data

Dec. 20, 2019 (EP) ..... 19218880

(51) Int. Cl.
*C21D 1/06* (2006.01)
*C21D 7/04* (2006.01)
*C21D 9/22* (2006.01)

(52) U.S. Cl.
CPC ..... *C21D 1/06* (2013.01); *C21D 7/04* (2013.01); *C21D 9/22* (2013.01)

(58) Field of Classification Search
CPC .... C21D 1/06; C21D 7/04; C21D 9/22; B22F 2009/042; B22F 2998/10; B22F 2005/001; C23C 24/045; C23C 26/00; C22C 29/08
See application file for complete search history.

(56) References Cited

U.S. PATENT DOCUMENTS 3,783,038 A 1/1974 Van Thyne et al.
7,258,833 B2 8/2007 Rainey et al.
(Continued)

FOREIGN PATENT DOCUMENTS

AU 2013273604 B2 12/2015
CN 101056996 A 10/2007
(Continued)

OTHER PUBLICATIONS

Roebuck et al. "A National Measurement Good Practice Guide a National Measurement Good Practice Guide Mechanical Tests for Hardmetals", Mechanical Tests for Hardmetals, Jan. 1, 1999, pp. 1-31. Retrieved from internet: URL:http://publications.npl.co.uk/npl_web/pdf/mgpg20.pdf retrieved on Mar. 4, 2016.

*Primary Examiner* — Anthony M Liang
*Assistant Examiner* — Danny N Kang
(74) *Attorney, Agent, or Firm* — Corinne R. Gorski

(57) ABSTRACT

A method of treating a sintered mining insert including cemented carbide includes the step of subjecting the mining insert to a surface hardening process. The surface hardening process is executed at an elevated temperature of or above 100° C. A mining insert is also provided, wherein the HV1 Vickers hardness measurement increase (HV1%) from the surface region, measured as an average of HV1 measurements taken at 100 μm, 200 μm and 300 μm below the
(Continued)

surface, compared to the HV1 Vickers hardness measured in the bulk (HV1bulk), is at least 8.05-0.00350×HV1bulk.

12 Claims, 2 Drawing Sheets

(56) References Cited

U.S. PATENT DOCUMENTS

| | | | | |
|---|---|---|---|---|
| 2011/0002804 | A1 | 1/2011 | Eason et al. | |
| 2014/0227053 | A1 | 8/2014 | Tokunaga et al. | |
| 2019/0112679 | A1 | 4/2019 | Flasar | |
| 2020/0030886 | A1* | 1/2020 | Martensson | C22C 29/08 |

FOREIGN PATENT DOCUMENTS

| | | | |
|---|---|---|---|
| CN | 101962710 | A | 2/2011 |
| CN | 102209599 | A | 10/2011 |
| CN | 103710603 | A | 4/2014 |
| CN | 106521487 | A | 3/2017 |
| CN | 109790076 | A | 5/2019 |
| EP | 2638992 | A1 | 9/2013 |
| EP | 3546608 | A1 | 10/2019 |
| WO | 2018060125 | A1 | 4/2018 |

* cited by examiner

METHOD OF TREATING A MINING INSERT

RELATED APPLICATION DATA

This application is a § 371 National Stage Application of PCT International Application No. PCT/EP2020/087073 filed Dec. 18, 2020 claiming priority to EP 19218880.3 filed Dec. 20, 2019.

TECHNICAL FIELD

The present invention is related to a method of treating a cemented carbide mining insert wherein post sintering the mining insert is subjected to a surface hardening process at an elevated temperature and a cemented carbide mining insert treated according to this method.

BACKGROUND

Cemented carbide has a unique combination of high elastic modulus, high hardness, high compressive strength, high wear and abrasion resistance with a good level of toughness. Therefore, cemented carbide is commonly used in products such as mining tools. Cemented carbide mining inserts are commonly treated with an edge deburring and surface hardening process, such as tumbling, post sintering and centreless grinding. The surface hardening process introduces compressive stress into the mining inserts. The presence of the compressive stresses improves the fatigue resistance and fracture toughness of the mining insert. Consequently, the threshold energy necessary to fracture the mining insert is higher and so there is a reduced likelihood of chipping, cracking and/or fracture of the component. Therefore, it is desirable to increase the level of compressive stress introduced into the mining insert to increase the lifetime of the insert.

High energy tumbling (HET) methods such as those disclosed in U.S. Pat. No. 7,258,833B2 provide a way to increase the level of compressive stresses introduced, however there it is desirable to be able to improve this process further by providing a method that can introduce even higher levels of the compressive stresses into the mining inserts without damaging them.

It is an object of the present invention to provide a method of introducing higher levels of compressive stress into a cemented carbide mining insert keeping the damage level down.

SUMMARY OF INVENTION

Thus, the present disclosure provides a method of treating a sintered mining insert comprising cemented carbide wherein said mining insert is subjected to a surface hardening process, characterized in that the surface hardening process is executed at an elevated temperature of or above 100° C., preferably at a temperature of or above 200° C., more preferably at a temperature of between 200° C. and 450° C.

The advantage of the present method is that higher levels of compressive stresses are introduced into the cemented carbide mining insert. An elevated tumbling temperature results in increased toughness of the carbide and hence the collisions do not result in defects such as micro cracks, large cracks or edge chipping. The higher level of compressive stress in combination with decreased collision defects will improve the fatigue resistance and fracture toughness of the mining insert and consequently increase the lifetime of the insert. Further advantages of this method are that insert geometries, such as those with a sharp bottom radius, which were previously prone to excessive damage to the corners and therefore low yields, can now be tumbled without causing edge damage. This opens the possibility to develop mining insert products with different geometries, which were previously not suitable for tumbling. The method also makes it possible to use cemented carbide compositions that would have previously been too brittle for mining applications or for high energy tumbling described in U.S. Pat. No. 7,258,833B2, Epiroc Smith, for example, inserts having a high level of eta-phase or lower binder content. Increasing the surface treatment process temperature from room temperature up to temperatures such as ~300° C., results in a hardness drop of more than 200 HV20, which gives rise to a toughness increase. The ability to introduce higher levels of compressive stress means that the toughness of the mining inserts is increased to an acceptable level and thus mining inserts having a higher hardness can be used which is beneficial for increasing the wear resistance of the mining inserts.

Additionally, the present disclosure provides a mining insert, wherein the HV1 Vickers hardness measurement increase (HV1%) from the surface region, measured as an average of HV1 measurements taken at 100 μm, 200 μm and 300 μm below the surface, compared to the HV1 Vickers hardness measured in the bulk (HV1bulk) is at least HV1%>8.05-0.0035×HV1bulk.

The advantage of this is that the crush strength of the mining insert is increased, which therefore leads to an increased lifetime of the mining insert.

DETAILED DESCRIPTION

Figure 1:
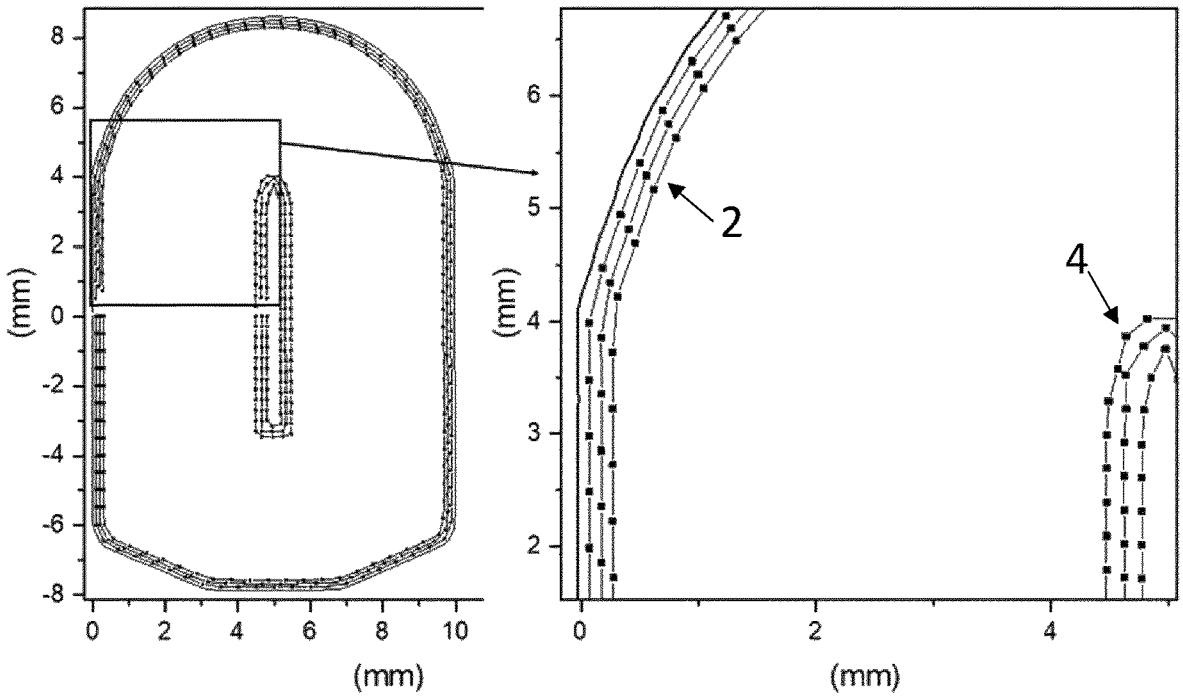
FIG. 1: HV1 maps for surface and bulk hardness measurements.

According to one aspect of the present invention is a method of treating a sintered mining insert, comprising cemented carbide wherein said mining insert is subjected to a surface hardening process, characterized in that the surface hardening process is executed at an elevated temperature of or above 100° C., preferably at a temperature of or above 200° C., more preferably at a temperature of between 200° C. and 450° C.

By "cemented carbide" is herein meant a material that comprises at least 50 wt % WC, possibly other hard constituents common in the art of making cemented carbides and a metallic binder phase preferably selected from one or more of Fe, Co and Ni. In one embodiment of the method, the cemented carbide mining insert contains a hard phase comprising at least 80 wt % WC, preferably at least 90 wt %.

The metallic binder of the cemented carbide can comprise other elements that are dissolved in the metallic binder during sintering, such as W and C originating from the WC. Depending on what other types of hard constituents that are present, also other elements can be dissolved in the binder.

A surface hardening treatment is defined as any treatment that introduces compressive stresses into the material through physical impacts, that results in deformation hardening at and below the surface, for example tumbling or shot peening. The surface hardening treatment is done post sintering and grinding. It has unexpectedly been found, that treating a mining insert with a surface hardening treatment at elevated temperatures decreases or even eliminates the carbide to carbide collision damages in terms of chipping and micro fracturing and therefore improving product lifetime. The surface hardening process of the present invention is performed at an elevated temperature, and this temperature is herein defined as the temperature of the mining insert at the start of the surface hardening process. The upper limit for the temperature, where the surface hardening process is performed, is preferably below the sintering temperature, more preferably below 900° C. The temperature of the mining insert is measured by any method suitable for measuring temperature, such as an infrared temperature measurement.

In one embodiment of the present invention the mining insert is subjected to a surface hardening treatment at a temperature of between 150-250° C., preferably at a temperature of between 175-225° C.

In one embodiment of the present invention the upper limit for the surface hardening treatment is 700° C., preferably 600° C., more preferably 550° C.

In one embodiment of the present invention the mining insert is subjected to a surface hardening treatment at a temperature of between 300-600° C., preferably at a temperature of between 350-550° C., more preferably of between 450-550° C.

The temperature is measured on the mining insert using any suitable method for measuring temperature. Preferably, an infrared temperature measurement device is used.

In one embodiment the cemented carbide comprises hard constituents in a metallic binder phase, and wherein the metallic binder phase content in the cemented carbide is 4 to 30 wt %, preferably 5 to 15 wt %.

The binder phase content needs to be high enough to provide a tough behaviour of the mining insert. The metallic binder phase content is preferably not higher than 30 wt %, preferably not higher than 15 wt %. A too high content of binder phase reduces the hardness and wear resistance of the mining insert. The metallic binder phase content is preferably greater than 4 wt %, more preferably greater than 6 wt %.

In one embodiment metallic binder phase comprises at least 80 wt % of one or more metallic elements selected from Co, Ni and Fe.

Preferably Co and/or Ni, most preferably Co, even more preferably between 3 to 20 wt % Co. Optionally, the binder is a nickel chromium or nickel aluminium alloy. The carbide mining insert may optionally also comprise a grain refiner compound in an amount of 20 wt % of the binder content. The grain refiner compound is suitably selected from the group of carbides, mixed carbides, carbonitrides or nitrides of vanadium, chromium, tantalum and niobium. With the remainder of the carbide mining insert being made up of the one or more hard-phase components.

In one embodiment the cemented carbide additionally comprises Cr, in an amount such that the mass ratio of Cr/binder is of 0.043-0.19.

The mass ratio of the Cr/binder is calculated by dividing the weight percentage (wt %) of the Cr added to powder blend by the wt % of the binder in the powder blend, wherein the weight percentages are based on the weight of that component compared to the total weight of the powder blend. To a great extent the Cr is dissolved into the binder phase, however there could be some amount, e.g. up to 3 mass %, of undissolved chromium carbide in the cemented carbide body. It may however be preferable to only add Cr up to the mass ratio of Cr/binder so that all the Cr dissolved into the binder so that the sintered cemented carbide body is free of undissolved chromium carbides.

The mass ratio of Cr/binder could be between 0.043-0.19 preferably between 0.075-0.15, more preferably between 0.085-0.12. If the mass ratio of Cr/binder is too low, the positive effects of the Cr will be too small. If, on the other hand, the mass ratio of the Cr/binder is too high, there will be an increased formation in the concentration of chromium carbides, in which the binder will dissolve, thereby reducing the volume of the binder phase and consequently making the cemented carbide body too brittle.

The Cr is normally added to the powder blend in the form of $Cr_3C_2$ as this provides the highest proportion of Cr per gram of powder, although it should be understood that the Cr could be added to the powder blend using an alternative chromium carbide such as $Cr_{26}C_2$ or $Cr_7C_3$ or a chromium nitride.

The addition of the Cr also has the effect of improving the corrosion resistance of the cemented carbide body. The presence of the Cr also makes the binder prone to transform from fcc to hcp during drilling, this is beneficial for absorbing some of the energy generated in the drilling operation. The transformation will thereby harden the binder phase and reduce the wear of the button during use thereof. The presence of the Cr will increase the wear resistance of the cemented carbide and increase its ability for deformation hardening. The combination of the Cr in the cemented carbide powder and the application of the powder comprising a grain refiner compound and optionally a carbon-based grain growth promoter, to at least one portion of the surface of the compact produces a cemented carbide body having a chemical and hardness gradient which produce a cemented carbide mining insert with high wear resistance.

Apart from the hard-phase forming component, the binder and Cr containing component, incidental impurities may be present in the WC-based starting material.

In one embodiment of the present invention, the cemented carbide before being subjected to the surface hardening treatment has a bulk hardness between 1200-1900 HV1, preferably between 1300-1850 HV1, most preferably between 1400-1700 HV1.

In one embodiment of the present invention, the cemented carbide is not coated.

In one embodiment of the present invention, the cemented carbide comprises $M_7C_3$ carbides, and possibly also $M_3C_2$ carbides, where M is Cr and possibly one or more of W, Co and any other elements added to the cemented carbide. By that is herein meant that the $M_7C_3$ carbides should be clearly visible in a SEM (scanning electron microscope) image using backscattering at a magnification enough to detect particles of a size of 100 nm. In one embodiment of the present invention, the cemented carbide comprises $M_7C_3$ carbides in an amount given by the ratio vol % $M_7C_3$ carbides/vol % Co. Suitably the ratio vol % $M_7C_3$ carbides/vol % Co is between 0.01 to 0.5 preferably between 0.03 to 0.25. The vol % of $M_7C_3$ carbides and the Co binder can be measured by EBSD or image analysis using a suitable software.

In one embodiment, the cemented carbide has a Com/Co ratio $0.75 \leq Com/Co \leq 0.98$. Com is magnetic saturation in weight % and "Co" is the weight percentage of cobalt in the cemented carbide. Com is related to the magnetic saturation $4\pi\sigma_1$[$\mu Tm^3/kg$] of the cemented carbide to the magnetic saturation for pure metallic Co binder $4\pi\sigma_0=201.9$ [$\mu Tm^3/kg$] through the equation:

$$Com\ (\%)=4\pi\sigma_1*(100/201.9)$$

Reference: Measurement Good Practice Guide No. 20" by Roebuck et al. 1999 NPL

In one embodiment the cemented carbide is free from eta phase and graphite. If the binder phase consists of cobalt, the cemented carbide will be free from eta phase and graphite when the Com/Co ratio is 0.75≤Com/Co≤0.98. The metals used as binder phase in cemented carbides, like Co, Ni, and Fe are ferromagnetic. The saturation magnetization is the maximum possible magnetization of ferromagnetic material, characterized by parallel orientation of all magnetic moments inside the material. A Foerster KOERZIMAT 1.096 is used to determine the magnetic saturation (Com) dipole moment jS and the derived weight specific saturation magnetization σS (4πσ) of the inserts. The Co content is then measured with XRF (X-ray fluorescence) using a Malvern Panalytical Axios Max Advanced instrument. The Com/% Co range that is between eta phase and graphite formation is affected by changing the binder composition, such as by adding Cr, Fe, Ni etc.

The solubility of W in the binder phase is directly related to the carbon content. The amount of W in the binder increases with decreasing carbon content until the limit for eta phase formation is reached. If the carbon content would decrease even lower, the solubility of W in the binder will not increase further. In some cemented carbide grades where it is beneficial to obtain a high amount of W dissolved in the binder, the carbon content has been kept low but above the limit for eta phase formation.

In another embodiment of the present invention, the cemented carbide substrate comprises eta phase comprising $Me_{12}C$ and/or $Me_6C$ carbides where Me is one or more metals selected from W, Mo and the binder phase metals. The cemented carbides have a Com/Co ratio≤0.69. If other constituents are added e.g. grain growth inhibitors, gamma phase formers etc to the cemented carbide, the Com/Co ratio will be influenced. The eta phase formed is, however, not present as large agglomerates. Commonly, eta phase has been considered as unwanted in cemented carbide due to that it has traditionally been present in large agglomerates of eta phase grains, which are brittle and detrimental to the cemented carbide properties. The cemented carbide according to this embodiment of the present invention, should have an evenly distributed eta phase, by that is herein meant that the cemented carbide is free from large agglomerates. The amount of eta phase is at least 2 vol %, preferably at least 4 vol %. By providing the non-agglomerated eta phase by selecting a certain range of sub-stoichiometric carbon content as in the cemented carbide of this embodiment, the cemented carbide shows good properties. The eta phase is present in the microstructure as a fine dispersed phase. Common carbides of the eta phase are $W_6Co_6C$, $W_3Co_3C$, $W_6Ni_6C$, $W_3Ni_3C$, $W_6Fe_6C$, $W_3Fe_3C$. In one embodiment the eta phase comprises both $Me_{12}C$ and $Me_6C$.

In one embodiment the method additionally includes a step wherein prior to sintering a liquid dispersion or slurry comprising a grain refiner and carbon and/or nitrogen, and a grain growth promoter being carbon, is applied to least one portion of the surface of a compact of the cemented carbide, the grain refiner compound and the grain growth promoter are both provided onto the surface or surfaces in an amount of from 0.1 to 100 mg/cm$^2$.

The grain refiner compound is a carbide, mixed carbide, carbonitride or a nitride, the grain refiner compound and grain growth promoter is provided on the surface of the compact by first providing a compact and then providing the grain refiner compound and the grain growth promoter on at least one portion of the surface of the compact, the grain refiner compound and grain growth promoter is provided by application in the form of a separate or combined liquid dispersion or slurry to the compact, the weight ratio of grain refiner compound to grain growth promoter is from about 0.05 to about 50. The compact is sintered after the grain refiner compound and grain growth promotor have been applied to the surface of the compact prior to the surface hardening treatment.

The grain refiner compound is preferably a carbide or nitride of chromium or vanadium. Further details on the method for applying the grain refiner compound and grain growth promoter to the surface of the cemented carbide compacts can be found in EP2355948B1.

In one embodiment the method includes a step of heating the mining inserts and media prior to the surface hardening process and the surface hardening process is performed on heated mining inserts.

The mining insert can be heated in a separate step prior to the surface hardening process step. Several methods can be used to create the elevated temperature of the mining insert, such as induction heating, resistance heating, hot air heating, flame heating, pre-heating on a hot surface, in an oven or furnace or using laser heating.

In an alternative embodiment, the mining inserts are kept heated during the surface hardening process. For examples using an induction coil.

In one embodiment after the mining inserts have been subjected to the surface hardening process at an elevated temperature, the mining inserts are subjected to a second surface hardening process at room temperature. Advantageously, this removes debris and oxides, for example iron oxide, that are deposited on the insert surfaces from the inside of the process container. The second surface hardening process performed at room temperature could be performed in wet conditions, which will aid in removing dirt and dust from the mining inserts being treated which reduces health hazards.

In one embodiment the surface hardening process is tumbling. The tumbling treatment could be centrifugal or vibrational. A "standard" tumbling process would typically be done using a vibrational tumbler, such as a Reni Cirillo RC 650, where about 30 kg inserts would be tumbled at about 50 Hz for about 40 minutes. An alternative typical "standard" tumbling process would be using a centrifugal tumbler such as the ERBA-120 having a closed lid at the top and has a rotating disc at the bottom. One more method is the centrifugal barrel finishing process. In both centrifugal processes, the rotation causes the inserts to collide with other inserts or with any media added. For "standard" tumbling using a centrifugal tumbler the tumbling operation would typically be run from 120 RPM for at least 20 minutes. The lining of the tumbler may form oxide or metal deposits onto the surface of the inserts.

It may be necessary to modify the lining of the tumbler to be able to withstand the higher elevated temperatures that the process is conducted at.

In one embodiment the tumbling process is a "High Energy Tumbling" (HET) process, wherein post tumbling a homogenous cemented carbide mining insert has been deformation hardened such that $\Delta HV3\% \leq 9.72 - 0.00543 * HV3_{bulk}$, wherein the ΔHV3% is the percentage difference between the HV3 measurement at 0.3 mm from the surface compared the HV3 measurement in the bulk.

To introduce higher levels of compressive stresses into the cemented carbide mining insert, a high energy tumbling process may be used. There are many different possible process set ups that could be used to introduce HET, including the type of tumbler, the volume of media added (if any), the treatment time and the process set up, e.g. RPM for a centrifugal tumbler etc. Therefore, the most appropriate way to define HET is in terms of "any process set up that introduces a specific degree of deformation hardening in a homogenous cemented carbide mining insert consisting of WC—Co, having a mass of about 20 g". In the present disclosure, HET is defined as a tumbling treatment that would introduce a hardness change, measured using HV3, after tumbling (ΔHV3%) of at least:

$$\Delta HV3\% = 9.72 - 0.00543 * HV3_{bulk} \quad \text{(equation 1)}$$

Wherein:

$$\Delta HV3\% = 100 * (HV3_{0.3\ mm} - HV3_{bulk}) / HV3_{bulk} \quad \text{(equation 2)}$$

$HV3_{bulk}$ is an average of at least 30 indentation points measured in the innermost (centre) of the cemented carbide mining insert and $HV3_{0.3\ mm}$ is an average of at least 30 indentation points at 0.3 mm below the tumbled surface of the cemented carbide mining insert. This is based on the measurements being made on a cemented carbide mining insert having homogenous properties. By "homogeneous properties" we mean that post sintering the hardness different is no more than 1% from the surface zone to the bulk zone. The tumbling parameters used to achieve the deformation hardening described in equations (1) and (2) on a homogenous cemented carbide mining insert would be applied to cemented carbide bodies having a gradient property.

HET tumbling may typically be performed using an ERBA 120, having a disc size of about 600 mm, run at about 150 RPM if the tumbling operation is either performed without media or with media that is larger in size than the inserts being tumbled, or at about 200 RPM if the media used is smaller in size than the inserts being tumbled; Using a Rosier tumbler, having a disc size of about 350 mm, at about 200 RPM if the tumbling operation is either performed without media or with media that is larger in size than the inserts being tumbled, or at about 280 RPM if the media used is smaller in size than the inserts being tumbled. Typically, the parts are tumbled for at least 40-60 minutes.

In one embodiment the tumbling process is conducted in dry conditions. The effect of the surface hardening treatment at elevated temperatures is enhanced if the process is done in dry conditions. By "dry" conditions it is meant that no liquid is added to the process. Without being found by this theory, it is thought that, if liquid is introduced to the process, it will lower the temperature of the parts. Further, the inclusion of the liquid will reduce the degree of the impact between the parts being tumbling. The internal friction will generate and preserve heat.

The tumbling process could be conducted in the presence or absence of tumbling media depending on the geometry and material composition of the mining inserts being tumbled. If it is decided to add tumbling media, the type and ratio of media to inserts is selected to suit the geometry and material composition of the mining inserts being tumbled.

Optionally, all or part of the heat is generated by friction between the inserts and any media added in the tumbling process.

Optionally, the inserts are further subjected to a second surface hardening process. Preferably, if a second surface hardening process performed at room temperature is done, this second surface hardening process is HET tumbling at room temperature in wet condition.

Figure 2:
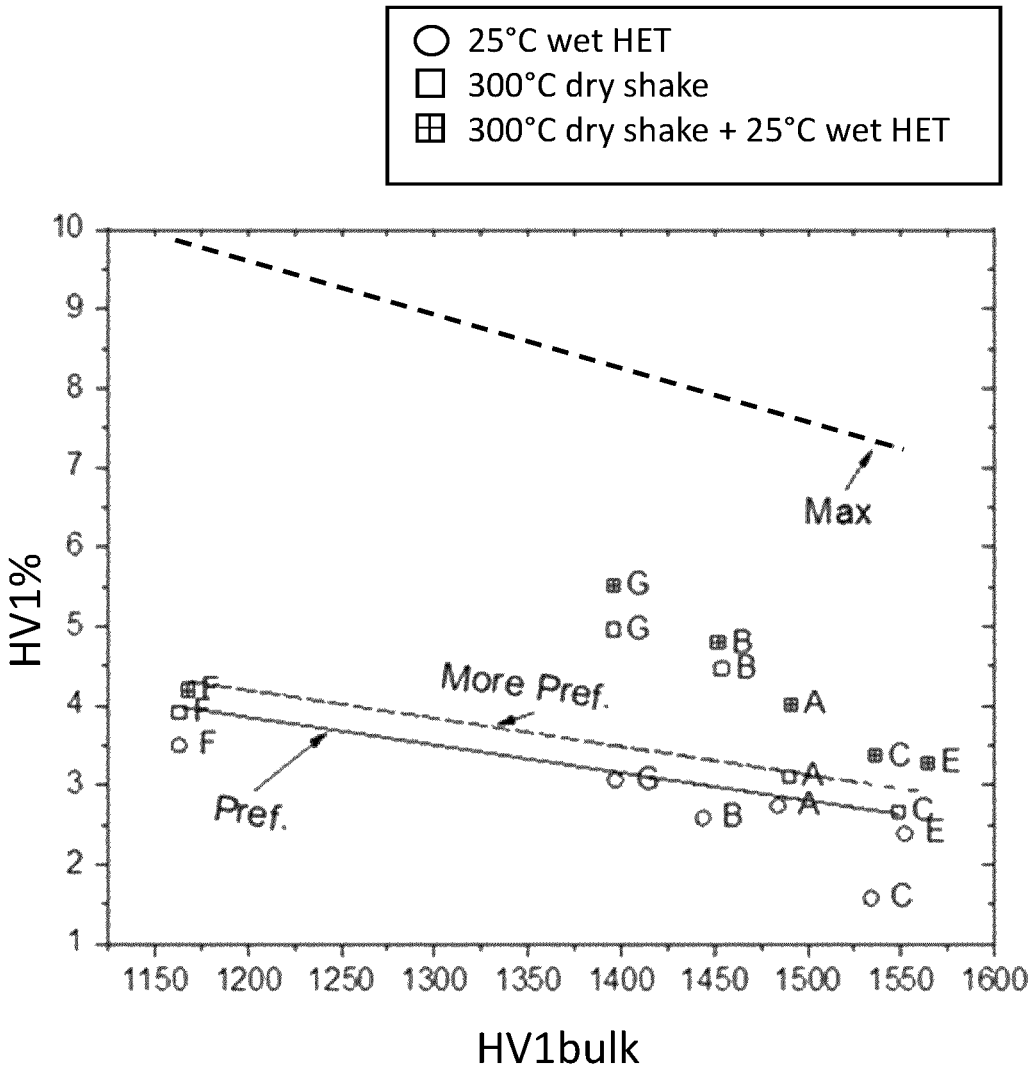
FIG. 2: Plots showing the HV1% trend lines.

In one embodiment the mining insert treated with a surface hardening process at elevated temperature has a HV1 Vickers hardness measurement increase (HV1%) from the surface region, measured as an average of HV1 between 100-300 μm below the surface, compared to the HV1 Vickers hardness measured in the bulk (HV1bulk) is at least HV1%>8.05−0.00350×HV1bulk, preferably HV1%>8.45−0.00355×HV1bulk. Preferably, HV1%<17.5−0.00662×HV1bulk. This is shown in FIG. 2.

By the term "bulk" is herein meant the innermost part (centre) of the cutting tool and for this disclosure is the zone having the lowest hardness.

The hardness of the cemented carbide inserts is measured using Vickers hardness automated measurement. The cemented carbide bodies are sectioned along the longitudinal axis and polished using standard procedures. The sectioning is done with a diamond disc cutter under flowing water. Vickers indentations at a 1 kg load are then equidistantly distributed over the polished section at the given depths below surface. The hardness of the surface zone is an average of about 180 indentations taken at the given distances 100, 200 and 300 μm below the surface. The hardness of the bulk is an average of about 150 indentations taken at the given distances 4.50, 4.65 and 4.80 mm below the surface. FIG. 1 shows the HV1 layout where the filled squares represent the locations surface indications 2 and the bulk indications 4.

The hardness measurements are performed using a programmable hardness tester, KB30S by KB Prüftechnik GmbH calibrated against HV1 test blocks issued by Euro Products Calibration Laboratory, UK. Hardness is measured according to ISO EN6507.

HV1 measurements were done in the following way:

- Scanning the edge of the sample.
- Programming the hardness tester to make indentations at specified distances from the edge of the sample.
- Indentation with 1 kg load at all programmed co-ordinates.
- The computer moves the stage to each co-ordinate, locates the microscope over each indentation, and runs auto adjust light, auto focus and the automatically measures the size of each indentation.
- The user inspects all the photos of the indentations for focus and other matters that disturb the result.

In one embodiment the residual stress of 20 g mining insert post the surface hardening process at an elevated temperature is at least 1250 MPa.

The residual stress measurements were analyzed using X-ray diffraction on the insert top by using a Bruker D8 Discovery with Cu Kα (1.54 Å) with a parallel beam poly-capillary and with a collimator with 0.5 mm aperture.

The measurement was performed using the iso-inclination method (sin 2ψ) method) at 11 different ψ angles from −45 to 45° and 3 different φ at 0, 45 and 90°. The elongation was calculated for peak displacements for the Bragg peak with hkl: 311 (117.32° 2θ). For the calculation of the residual stresses, the software Leptos (Bruker) was used. The input values for the calculations were 650 MPa for the E-module and 0.19 for Poisson's constant. Since we assume that there is no directional dependence on the residual stresses, a "normal" voltage model (not biaxial) was used. And the measurements at the 3 φ angles for each sample are considered as individual measurements. The diffractometer is continuously checked with a corundum sample (NIST standard) to ensure alignment.

EXAMPLES

Example 1—Starting Materials and Tumbling Conditions

Mining inserts with different compositions (based on the starting composition of the powders weighed in to the milled) were tested. Table 1 shows the summary of the compositions of the mining inserts tested:

TABLE 1

Composition of mining inserts tested. * measured 0.5 mm below the tip since D is a gradient.

| Mining insert composition | WC (wt %) | Co (wt %) | Cr (wt %) | Com/Co | HV1 (bulk) | HV20 (bulk) | Dipped in slurry? |
|---|---|---|---|---|---|---|---|
| A | 94 | 6.0 | 0 | 0.92 | 1488 | 1470 | No |
| B | 93.4 | 6.0 | 0.6 | 0.78 | 1450 | 1420 | No |
| C | 94 | 6.0 | 0 | 0.61 | 1540 | 1510 | No |
| D | 94 | 6.0 | 0 | 0.77 | 1500 | 1520* | Yes |
| E | 94 | 6.0 | 0 | 0.83 | 1558 | 1530 | No |
| F | 89 | 11 | 0 | 0.95 | 1165 | 1120 | No |
| G | 95 | 5.0 | 0.5 | 0.81 | 1397 | 1380 | No |

Sample A, E and F represent a "standard" cemented carbide grades used for mining inserts. Samples B and G contain chromium and sample C contains eta phase. All cemented carbide inserts were produced using a WC powder grain size measured as FSSS was before milling between 5 and 18 μm. The WC and Co powders were milled in a ball mill in wet conditions, using ethanol, with an addition of 2 wt % polyethylene glycol (PEG 8000) as organic binder (pressing agent) and cemented carbide milling bodies. After milling, the mixture was spray-dried in $N_2$-atmosphere and then uniaxially pressed into mining inserts having a size of about 10 mm in outer diameter (OD) and about 17-20 mm in height with a weight of approximately 20 g each with a spherical dome ("cutting edge") on the top. The samples were then sintered using Sinter-HIP in 55 bar Ar-pressure at 1410° C. for 1 hour. Sample D is the same starting material as sample A, but prior to sintering the samples were dipped in a slurry comprising 25 wt % $Cr_3C_2$ and 5 wt % graphite dispersed in water applied to the surface of the cemented carbide mining insert so that about 60% of the total insert length was exposed to the slurry.

For comparison a batch of 25 or 50 of each of the samples A-D was treated using a HET centrifugal tumbling process at 25° C. (room temperature) in a Rosier FKS04 tumbler at 300 RPM for 50 minutes with 50 kg of 7 mm carbide balls of grade H10F in wet conditions. In the tables of the results samples treated according to this method is referred to as "25° C. wet HET".

In order to replicate tumbling at an elevated temperature on a lab scale a "hot shaking" method has been used. The hot shaking method uses a commercially available paint shaker of trade mark Corob™ Simple Shake 90 with a maximum load of 40 kg and a maximum shaking frequency of 65 Hz. The "hot shaking" method was conducted in batches of 50 mining inserts at a frequency of 45 Hz. About 800 grams or 50 pieces of inserts and 4.2 kg carbide media (1560 pieces of about 7 mm balls) where placed in a cylindrical steel container with inner diameter of 10 cm and inner height of 12 cm filling it up to ⅔ of the height. The steel cylinder with the mining insert were heated with media in a furnace to an elevated temperature of 100, 200 or 300° C., the mining inserts were held at the target temperature for 120 minutes. After heating, the steel cylinder was transferred straight into the paint shaker and immediately shook for 9 minutes. The transfer time between the furnace until the shaker started was less than 20 seconds. The media was made of the cemented carbide grade H10F having 10 wt % Co, 0.5 wt % Cr and 89.5 wt % WC that results in sintered HV20 of about 1600. In the tables of results samples treated according to this method are referred to as "100° C. dry shake", "200° C. dry shake" or "300° C. dry shake" depending on the temperature used. The shaking was performed in dry conditions, i.e. no water was added to the shaking. Some samples were also treated by shaking in dry conditions at room temperature, in the table of results this method is referred to as "25° C. dry shake". For these samples the 25° C. denotes the temperature at the start of the treatment, however due to friction and collision heat formed during the 9-minute shaking process the final temperature in the steel cylinder is actually between 60-100° C., i.e. also "elevated". Following the shaking the samples were then cooled down and treated using the HET centrifugal tumbling process described above as well as a second surface hardening process. In the tables of results samples treated according to this method are referred to as "300° C. shake dry+25° C. HET wet".

Example 2—Edge Damage

It is important that the damage to the edges of the mining inserts is low, preferably none at all, post tumbling in order to have the highest yields.

The mining inserts were inspected visually for damages post tumbling for to compare the yields of good quality mining inserts if the surface hardening treatment is done at room temperature vs 300° C. The mining insert was counted as having damage if the chipping was greater than about 1 mm in length or if the chipping reached out to the centreless ground cylindrical surface of the insert. The percentage of damaged inserts reported in table 2:

TABLE 2

Percentage of mining inserts being damaged post shaking treatment.

| | Surface hardening treatment | | | | |
|---|---|---|---|---|---|
| Mining insert composition | "25° C. shake wet" (100ml water added) (comparison) | "25° C. dry shake" (invention) | "100° C. shake dry (invention) | "200° C. shake dry" (invention) | "300° C. dry shake (invention) |
| A | 10% | 6% | 4% | 4% | 0% |
| B | 26% | 4% | 0% | 2% | 0% |
| C | 96% | 70% | 68% | 50% | 8% |
| D | | 0% | 0% | 0% | 0% |

The temperatures stated for the surface hardening treatments are starting temperatures. For the batches treated with a starting temperature of 25° C., if water is added to the process, the temperature is not expected to significantly increase as the samples are treated, where for the samples treated in dry conditions, there will be an increase in temperature as heat is generated by friction between the inserts and the media in the tumbling process. The results in table 2 show that there is a reduction in the amount of edge damage to the mining inserts if the surface hardening treatment is conducted at an elevated temperature.

Example 3—Insert Compression Test

The insert compression test method involves compressing a drill bit insert between two plane-parallel hard counter surfaces, at a constant displacement rate, until the failure of the insert. A test fixture based on the ISO 4506:2017 (E) standard "Hardmetals—Compression test" was used, with cemented carbide anvils of hardness exceeding 2000 HV, while the test method itself was adapted to toughness testing of rock drill inserts. The fixture was fitted onto an Instron 5989 test frame.

The loading axis was identical with the axis of rotational symmetry of the inserts. The counter surfaces of the fixture fulfilled the degree of parallelism required in the ISO 4506:2017 (E) standard, i.e. a maximum deviation of 0.5 μm/mm. The tested inserts were loaded at a constant rate of crosshead displacement equal to 0.6 mm/min until failure, while recording the load-displacement curve. The compliance of the test rig and test fixture was subtracted from the measured load-displacement curve before test evaluation. Five inserts were tested per sample type. The counter surfaces were inspected for damage before each test. Insert failure was defined to take place when the measured load suddenly dropped by at least 1000 N. Subsequent inspection of tested inserts confirmed that this in all cases this coincided with the occurrence of a macroscopically visible crack. The material toughness was characterized by means of the total absorbed deformation energy until fracture. The summary fracture energy, in Joules (J), required to crush the samples is shown in table 3 below:

TABLE 3

Fracture energy (J) required to crush the samples (Grade E was tested with a 2.5 mm tip radius while all other grades were tested with a 5 mm tip radius.)

| Mining insert composition | Surface hardness treatment | | |
|---|---|---|---|
| | "25° C. wet HET" (comparison) | "300° C. dry shake" (invention) | "300° C. dry shake + 25° C. wet HET" (invention) |
| A | 9.28 | 10.5 | 12.0 |
| B | 9.37 | 10.5 | 14.2 |
| C | 8.62 | 10.1 | 12.1 |
| D | 7.74 | 9.85 | 11.3 |
| E | 1.61 | — | 2.57 |
| F | 6.91 | 9.27 | 10.8 |
| G | 6.94 | 8.86 | 10.2 |

It can be seen that there is an increase in fracture energy for all samples when the surface hardening treatment is conducted at an elevated temperature compared to at room temperature.

Example 4—Field Trial

Top hammer bits were made having an initial bit diameter of about 49 mm with six peripheral inserts of 10 mm diameter and three front inserts of 9 mm. The insert geometry was conical with a spherical top of 2.5 mm radius.

Two bits were tested with each of the following type of inserts: Sample A, treated according to the standard centrifugal method "25° C. wet HET" surface hardening treatment, this represents standard inserts that would be used for top hammer drilling; Sample E, treated according to the "25° C. wet HET" surface hardening treatment, this material would generally considered too brittle and unsuitable for top hammer drilling; Sample E, treated according to the "300° C. dry shake+25° C. wet HET" surface hardening treatment, and is the inventive sample. The bits were tested on granodiorite rock in the Sandvik Test Mine in Myllypuro, Finland. The drill rig was equipped with a HLXS rock drill operating at full power which means percussive pressure 200 bar, feed pressure at 100 bar, rotation at 240 RPM and rotation pressure at 120 bar. The bits are classed as having failed if either the bit breaks or the bit would need re-sharpening before drilling could be continued. The average results from the two bits (per case) are shown in table 4 below:

TABLE 4

Field trial results

| Mining insert composition | Surface hardening treatment | Drilled depth before worn out (metres) | Bit diameter loss (mm) | Drilled meters per mm of bit diameter lost (m/mm) |
|---|---|---|---|---|
| A (comparative) | 25° C. wet HET | 236 | 0.81 | 291 |
| E (comparative) | 25° C. wet HET | 47 | Bits broke | — |
| E (inventive) | 300° C. dry shake + 25° C. wet HET | 289 | 0.85 | 340 |

It can be seen that by applying the surface hardening treatment at an elevated temperature the drilling performance is improved for the inventive sample compared to the standard material used for top hammer drilling (sample A heated according to the conventional method "25° C. wet HET") even for an insert grade, E, that would normally perform very badly if the surface hardening treatment is performed only at room temperature.

Example 5—Hardness Measurements

Hardness measurements were made according to the description explained hereinabove for the samples described in table 1. HV1 hardness was measured in the bulk (values in table 1) and at depths of 100, 200 and 300 μm below the surface of lengthwise cross sectioned samples and the percentage of hardness increase compared to the bulk is reported in table 5 for the samples treated according to the "300° C. dry shake+25° C. wet HET" surface hardening method.

TABLE 5

Percentage increase in HV1 at different depths below the surface compared to the bulk

| Mining insert composition | Depth below the surface | | |
|---|---|---|---|
| | 100 μm | 200 μm | 300 μm |
| A | 4.66 | 4.05 | 3.33 |
| B | 6.93 | 4.36 | 3.1 |
| C | 3.93 | 3.28 | 2.89 |
| D | 9.29 | 7.99 | 6.77 |

It can be seen that for all cases the there is an increase in HV1 at the surface of the mining insert compared to in the bulk.

Example 6—Residual Stress Measurements

Residual stress measurements were made on the samples according to the method described hereinabove. Table 6 shows that the residual stress in the samples is higher after a post tumbling treatment at an elevated temperature compared to a post tumbling treatment at room temperature.

TABLE 6

| Compressive stress measurements (Mpa) | | |
|---|---|---|
| | Surface hardening treatment | |
| Mining insert composition | "25° C. wet HET" (comparison) | "300° C. dry shake + 25° C. wet HET" (invention) |
| A | 1340 | 1386 |
| B | 1389 | 1610 |
| C | 1584 | 1564 |
| D | 1324 | 1415 |

The invention claimed is:

1. A method of treating a sintered mining insert including cemented carbide, wherein the cemented carbide comprises hard constituents in a metallic binder phase, and wherein the metallic binder phase content in the cemented carbide is 4 to 30 wt %, wherein the metallic binder phase comprises at least 80 wt % of one or more metallic elements selected from Co, Ni and Fe; wherein the hard phase comprises at least 80 wt % WC, the method comprising:

subjecting the mining insert to a surface hardening process, wherein the surface hardening process is tumbling, wherein the tumbling process is conducted in dry conditions, wherein the tumbling process is a High Energy Tumbling process, wherein post tumbling a homogenous cemented carbide mining insert has been deformation hardened such that $\Delta HV3\% > 9.72 - 0.00543 * HV3_{bulk}$, wherein the ΔHV3% is a percentage difference between a HV3 measurement at 0.3 mm from a surface of the insert compared a HV3 measurement in a bulk of the insert, and wherein the surface hardening process is executed at an elevated temperature of or above 100° C.

2. The method according to claim 1, wherein the metallic binder phase content in the cemented is 5 to 15 wt %.

3. The method according to claim 1, wherein the cemented carbide additionally includes Cr in an amount such that the mass ratio of Cr/binder is of 0.043-0.19.

4. The method according to claim 1, wherein the cemented carbide includes $M_7C_3$ carbides.

5. The method according to claim 1, wherein the cemented carbide has a Com/Co ratio: >0.75 and ≤0.98, wherein Com is a magnetic saturation in weight % and Co is a weight percentage of cobalt in the cemented carbide, Com being related to a magnetic saturation $4\pi\sigma_1$ [$\mu Tm^3/kg$] of the cemented carbide to a magnetic saturation for pure metallic Co binder $4\pi\sigma_0 = 201.9$ [$\mu Tm^3/kg$] through the equation:

$$Com\ (\%) = 4\pi\sigma_1 * (100/201.9).$$

6. The method according to claim 1, wherein the cemented carbide has a Com/Co ratio ≤0.69 and at least 2% volume eta phase, wherein Com is a magnetic saturation in weight % and Co is a weight percentage of cobalt in the cemented carbide, Com being related to a magnetic saturation $4\pi\sigma_1$ [$\mu Tm^3/kg$] of the cemented carbide to a magnetic saturation for pure metallic Co binder $4\pi\sigma_0 = 201.9$ [$\mu Tm^3/kg$] through the equation:

$$Com\ (\%) = 4\pi\sigma_1 * (100/201.9).$$

7. The method according to claim 1, wherein prior to sintering a liquid dispersion or slurry having a grain refiner compound including a grain refiner and carbon and/or nitrogen, and a grain growth promoter being carbon, is applied to least one portion of a surface of a compact of the cemented carbide, the grain refiner compound and the grain growth promoter both being provided onto the surface or surfaces in an amount of from 0.1 to 100 $mg/cm^2$.

8. The method according to claim 1, wherein the method further comprises a step of heating the mining inserts and tumbling media prior to the surface hardening process and the surface hardening process is performed on the heated mining inserts.

9. The method according to claim 8, wherein the mining inserts are kept heated during the surface hardening process.

10. The method according to claim 1, wherein after the mining inserts have been subjected to the surface hardening process at an elevated temperature, the mining inserts are subjected to a second surface hardening process at room temperature.

11. The method according to claim 1, wherein part of the heat is generated by friction between the insert and any media added in the tumbling process.

12. A mining insert produced according to the method of claim 1.

* * * * *